US006928904B2

(12) United States Patent
Hsien

(10) Patent No.: US 6,928,904 B2
(45) Date of Patent: Aug. 16, 2005

(54) HAND TOOL HAVING A QUICK DRIVING EFFECT

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/652,431

(22) Filed: Aug. 29, 2003

(65) Prior Publication Data

US 2005/0044994 A1 Mar. 3, 2005

(51) Int. Cl.[7] ..... B25B 13/46; B25B 23/16
(52) U.S. Cl. ..... 81/60; 81/177.8; 81/177.85
(58) Field of Search ..... 81/177.6–177.9, 81/177.1, 177.2, 58, 60–62

(56) References Cited

U.S. PATENT DOCUMENTS 4,991,468 A * 2/1991 Lee ..... 81/60
5,941,141 A * 8/1999 Whitley ..... 81/63.1
6,752,048 B1 * 6/2004 Chiang ..... 81/63.1
2004/0177731 A1 * 9/2004 Chen ..... 81/177.8

* cited by examiner

*Primary Examiner*—Debra S. Meislin

(57) ABSTRACT

A hand tool includes a driving member, and a wrench body mounted on the driving member. The wrench body includes a handle, a driving head mounted on an end of the handle, and a locking portion rotatably mounted on the driving head and inserted into the mounting hole of the driving member. Thus, the wrench body can drive the driving member to rotate through 360 degrees reciprocally so as to rotate and unscrew the nut successively, so that the driving member can be used to unscrew the workpiece easily and rapidly.

11 Claims, 10 Drawing Sheets

HAND TOOL HAVING A QUICK DRIVING EFFECT

BACKGROUND OF THE INVENTION

1. Field of the Invention

The present invention relates to a hand tool, and more particularly to a hand tool having a quick driving effect.

2. Description of the Related Art

A conventional wrench comprises a wrench body having a handle and a driving head mounted on an end of the handle for driving a workpiece, such as a nut or the like. Thus, the driving head is driven by the handle to rotate the nut. However, after the nut is rotated to a determined angle, movement of the handle is limited and the driving head cannot be further rotated, so that the user has to remove the driving head from the nut to adjust the position of the driving head relative to the nut and then to mount the driving head on the nut again so as to drive the nut to rotate, thereby causing inconvenience to the user in operation of the wrench.

SUMMARY OF THE INVENTION

The primary objective of the present invention is to provide a hand tool having a quick driving effect.

Another objective of the present invention is to provide a hand tool, wherein the wrench body can drive the driving member to rotate through 360 degrees reciprocally so as to rotate and unscrew the nut successively, so that the driving member can be used to unscrew the workpiece easily and rapidly.

A further objective of the present invention is to provide a hand tool, wherein the wrench body co-operates with the driving member to function as a ratchet socket wrench, thereby facilitating the user operating the workpiece.

In accordance with the present invention, there is provided a hand tool, comprising:

a driving member, and a wrench body mounted on the driving member for driving the driving member, wherein:

the driving member has a first end formed with a mounting hole;

the wrench body includes a handle, a driving head mounted on an end of the handle, and a locking portion rotatably mounted on the driving head and inserted into the mounting hole of the driving member.

Further benefits and advantages of the present invention will become apparent after a careful reading of the detailed description with appropriate reference to the accompanying drawings.

DETAILED DESCRIPTION OF THE INVENTION

Figure 1:
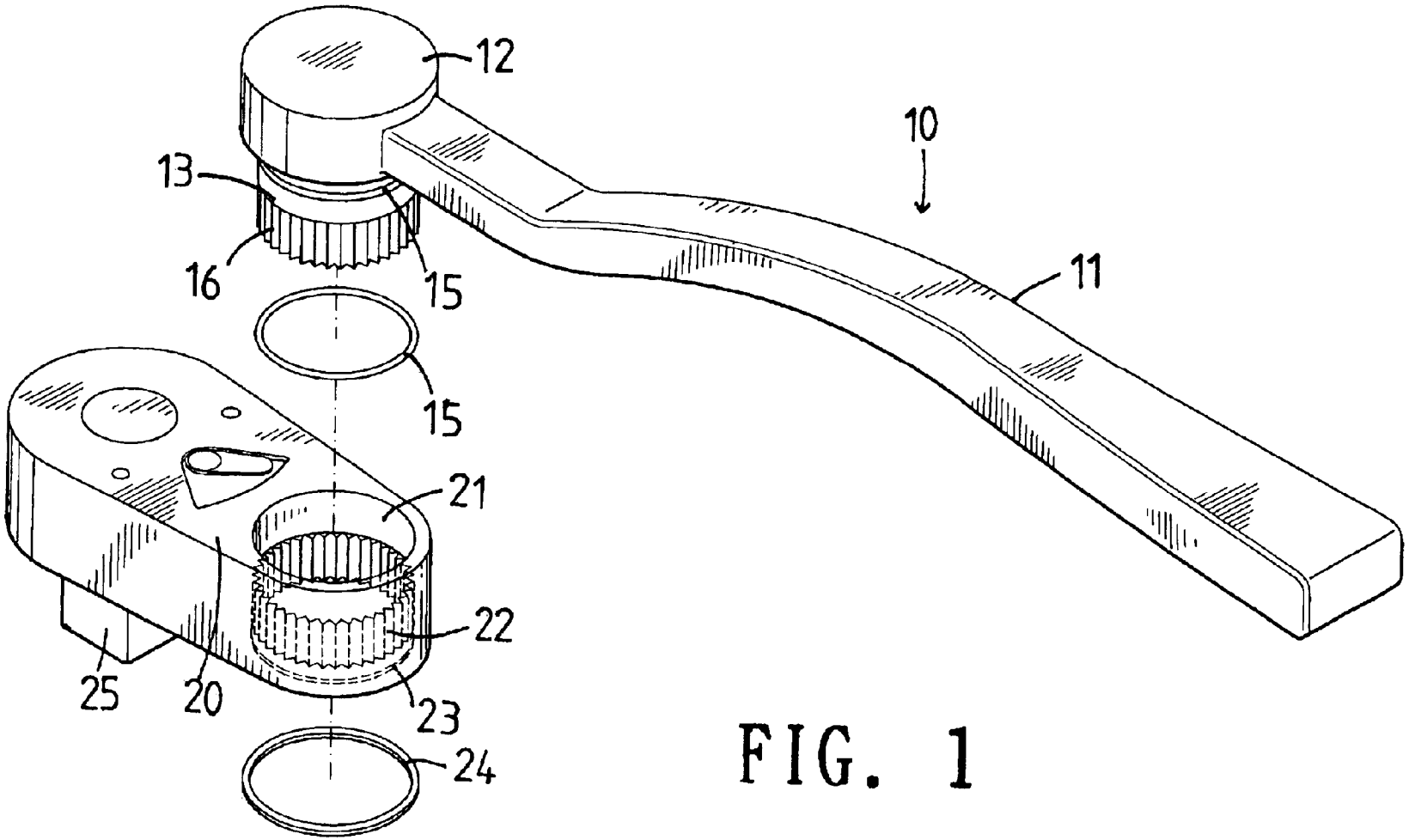
FIG. 1 is an exploded perspective view of a hand tool in accordance with the preferred embodiment of the present invention.

Referring to the drawings and initially to FIGS. 1–5, a hand tool in accordance with the preferred embodiment of the present invention comprises a driving member 20, and a wrench body 10 mounted on the driving member for driving the driving member 20.

The driving member 20 has a first end formed with a mounting hole 21 and a second end provided with a stud-shaped mounting portion 25. The mounting hole 21 of the driving member 20 has a wall provided with a plurality of ratchet teeth 22.

The wrench body 10 includes a handle 11, a driving head 12 mounted on an end of the handle 11, and a locking portion 13 rotatably mounted on the driving head 12 and inserted into the mounting hole 21 of the driving member 20.

The locking portion 13 of the wrench body 10 has a lower end provided with a plurality of locking teeth 16 meshing with the ratchet teeth 22 of the driving member 20. The locking portion 13 of the wrench body 10 has an upper end formed with an annular groove 14 for securing an elastic sealing ring 15 which is received in the mounting hole 21 of the driving member 20. Preferably, the sealing ring 15 has an outer diameter slightly greater than a diameter of the mounting hole 21 of the driving member 20, so that the sealing ring 15 is closely urged on the wall of the mounting hole 21 of the driving member 20, and the locking portion 13 of the wrench body 10 is combined with the driving member 20 rigidly and stably.

The mounting hole 21 of the driving member 20 has a bottom formed with an annular depression 23 located below the ratchet teeth 22 for securing a snap ring 24 which is rested on the lower end of the locking portion 13 of the wrench body 10 to prevent the locking teeth 16 from protruding outward from the driving member 20.

Figure 5:
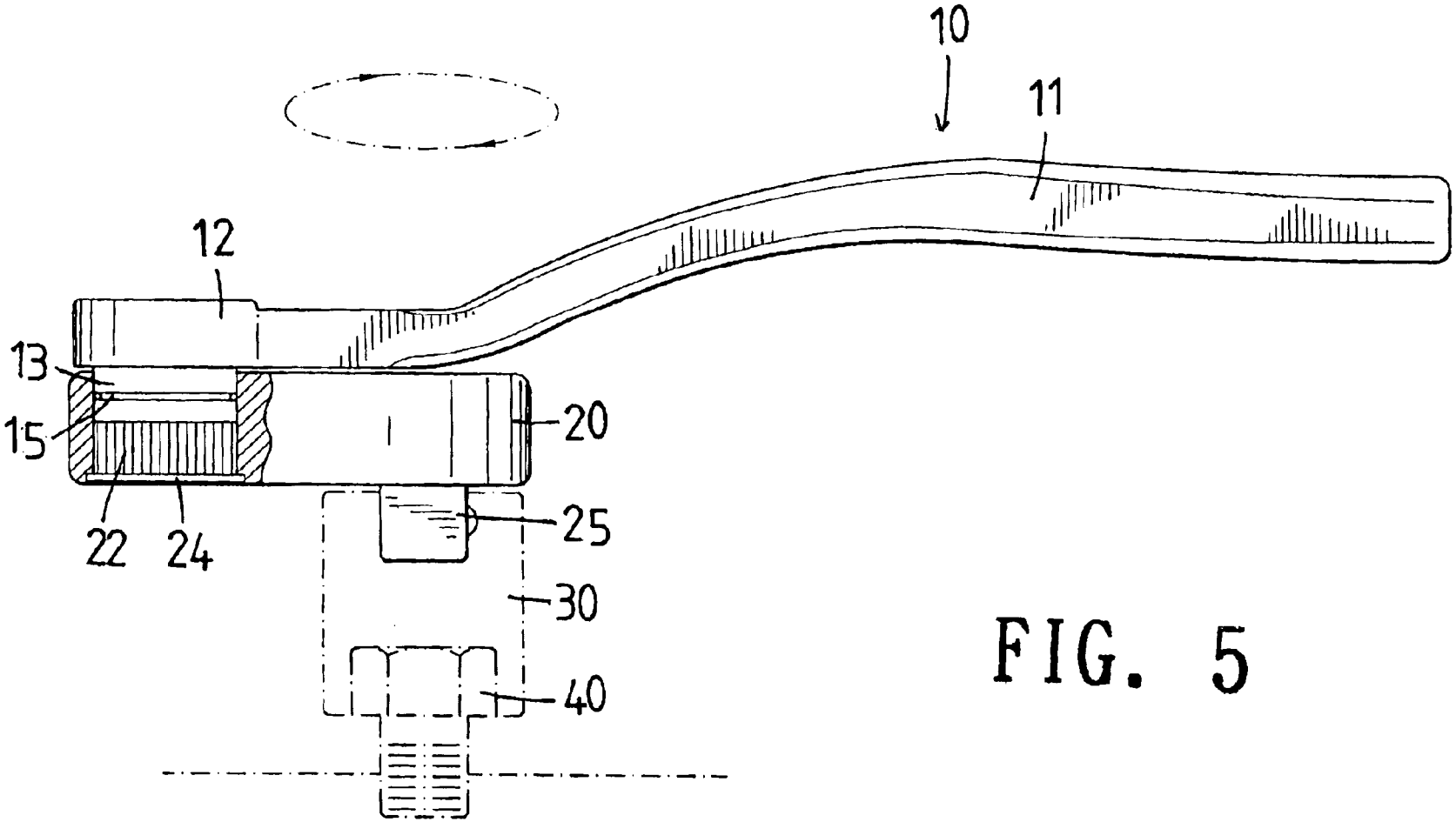
FIG. 5 is a schematic operational view of the hand tool as shown in FIG. 3.

In operation, the mounting portion 25 of the driving member 20 is mounted on a socket 30 (see FIG. 2) which is mounted on a nut 40 (see FIG. 5). Then, the handle 11 of the wrench body 10 is driven to rotate the driving member 20. At this time, the locking teeth 16 of the wrench body 10 mesh with the ratchet teeth 22 of the driving member 20, so that the driving member 20 is driven by the wrench body 10 to rotate about the mounting portion 25 so as to unscrew the nut 40 previously.

Then, the driving head 12 of the wrench body 10 is driven by the handle 11 to rotate the driving member 20. At this time, the locking portion 13 of the wrench body 10 is locked on the driving member 20 and is mounted on the driving head 12, so that the driving head 12 of the wrench body 10 can be rotated relative to the locking portion 13 of the wrench body 10 and the driving member 20.

Figure 2:
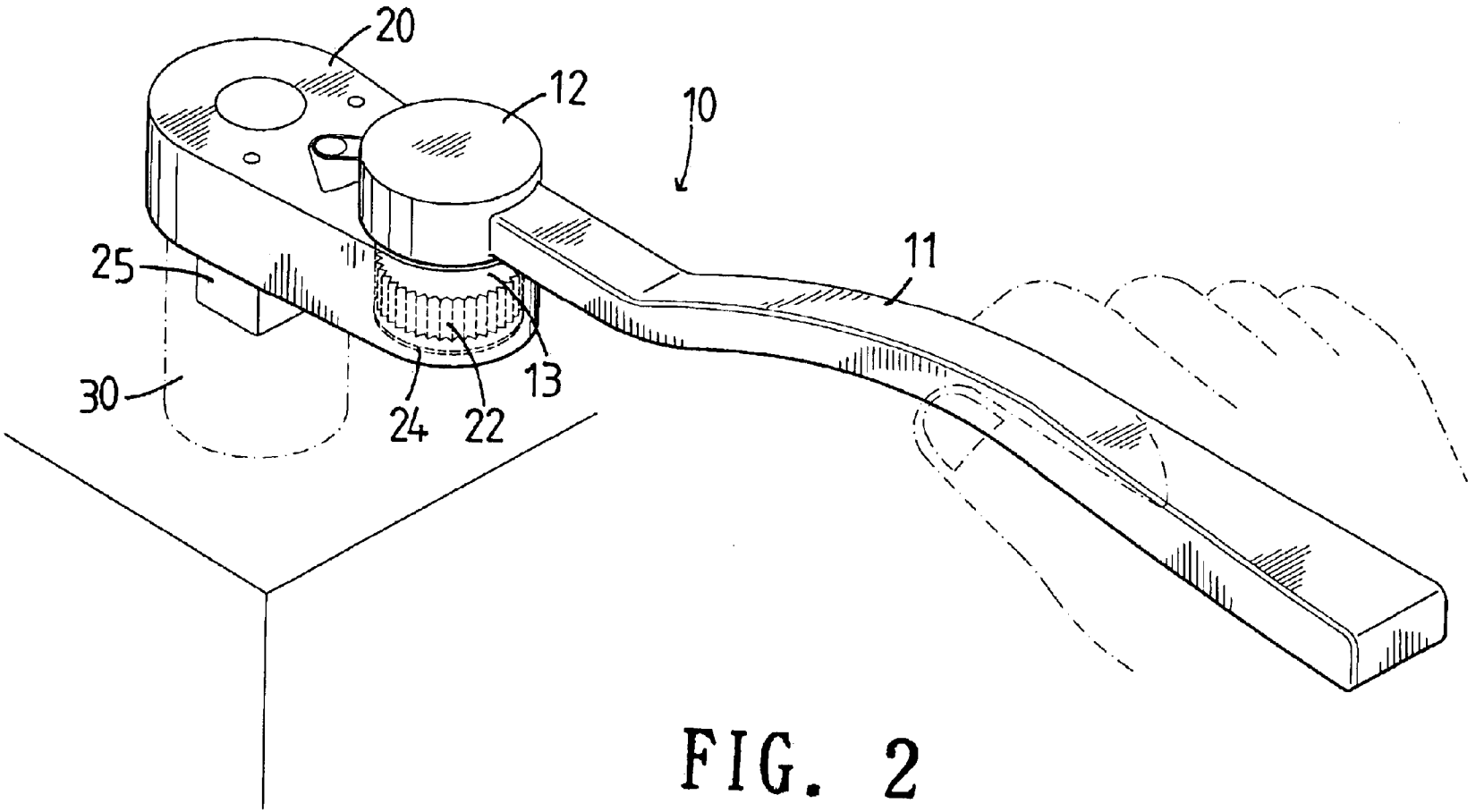
FIG. 2 is a perspective assembly view of the hand tool in accordance with the preferred embodiment of the present invention.
Figure 3:
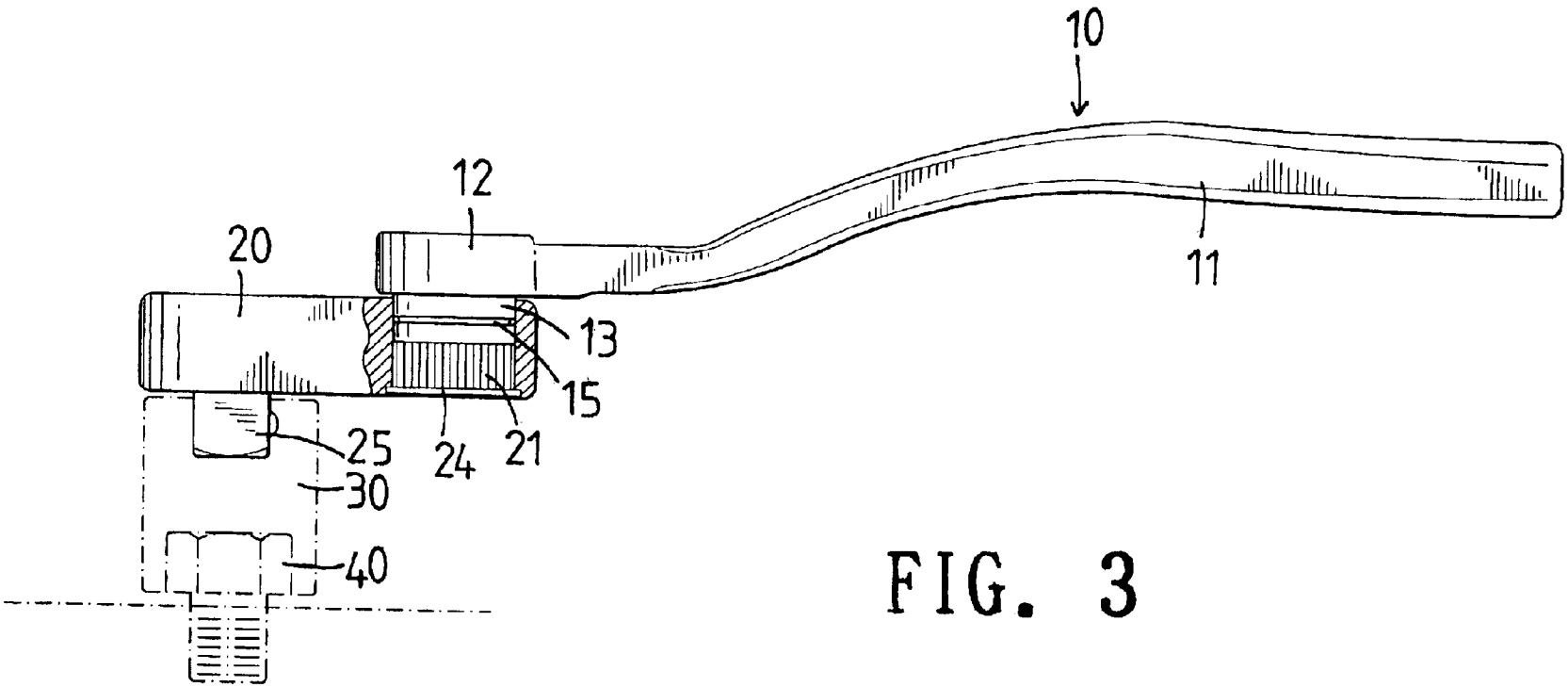
FIG. 3 is a partially plan cross-sectional view of the hand tool as shown in FIG. 2.
Figure 4:
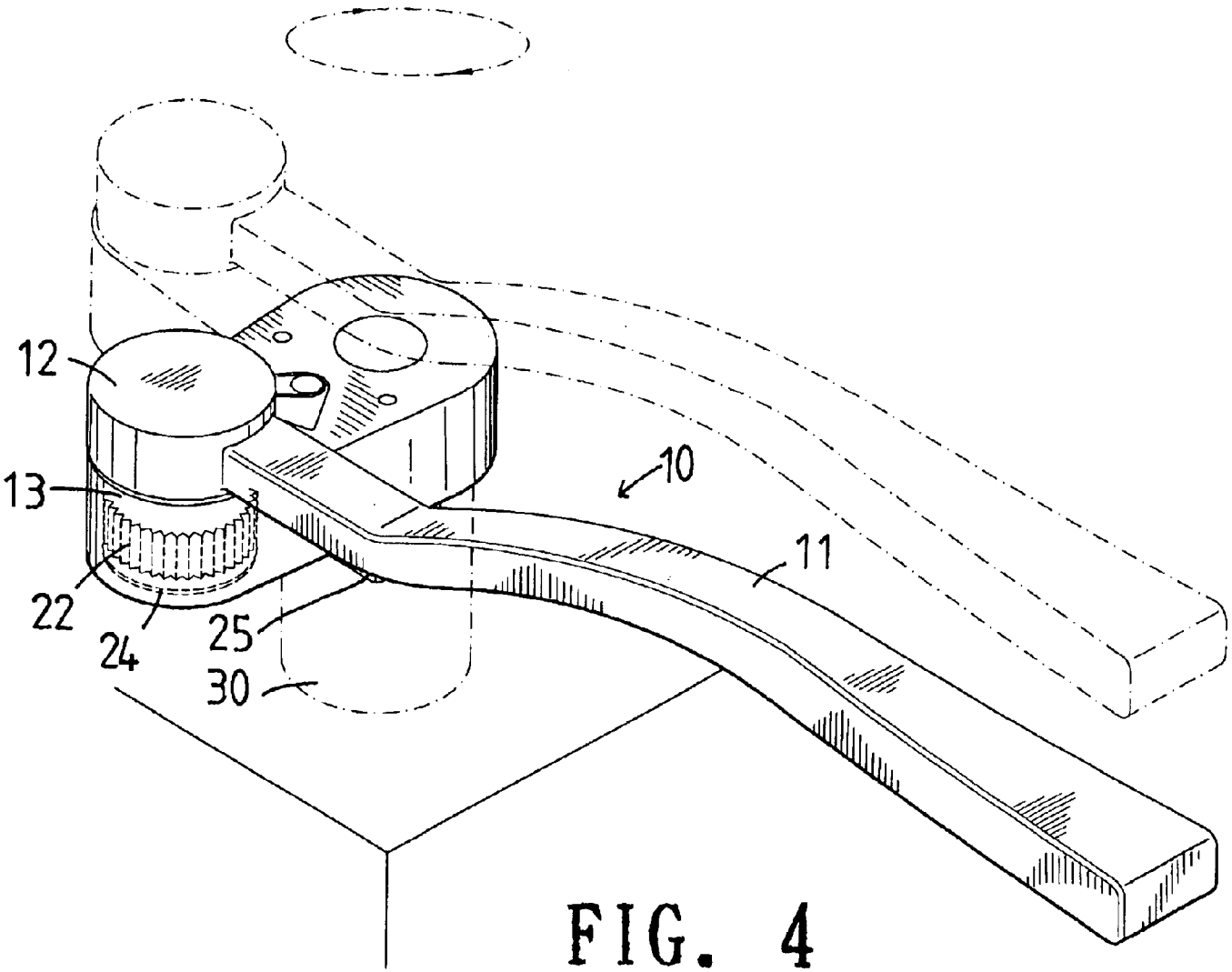
FIG. 4 is a schematic operational view of the hand tool as shown in FIG. 2.

Thus, when the driving head 12 of the wrench body 10 is driven, the driving head 12 of the wrench body 10 can exert a force on the locking portion 13 of the wrench body 10 to drive the driving member 20 to rotate about the mounting portion 25, so that the driving member 20 can be moved from the position as shown in FIG. 2 to the position as shown in FIG. 4, then to the position as shown in FIG. 5 and finally to the original position as shown in FIG. 2.

Accordingly, the wrench body 10 can drive the driving member 20 to rotate through 360 degrees reciprocally so as to rotate and unscrew the nut 40 successively, so that the driving member 20 can be used to unscrew the nut 40 easily and rapidly. In addition, the wrench body 10 co-operates with the driving member 20 to function as a ratchet socket wrench, thereby facilitating the user unscrewing the nut 40.

Figure 6:
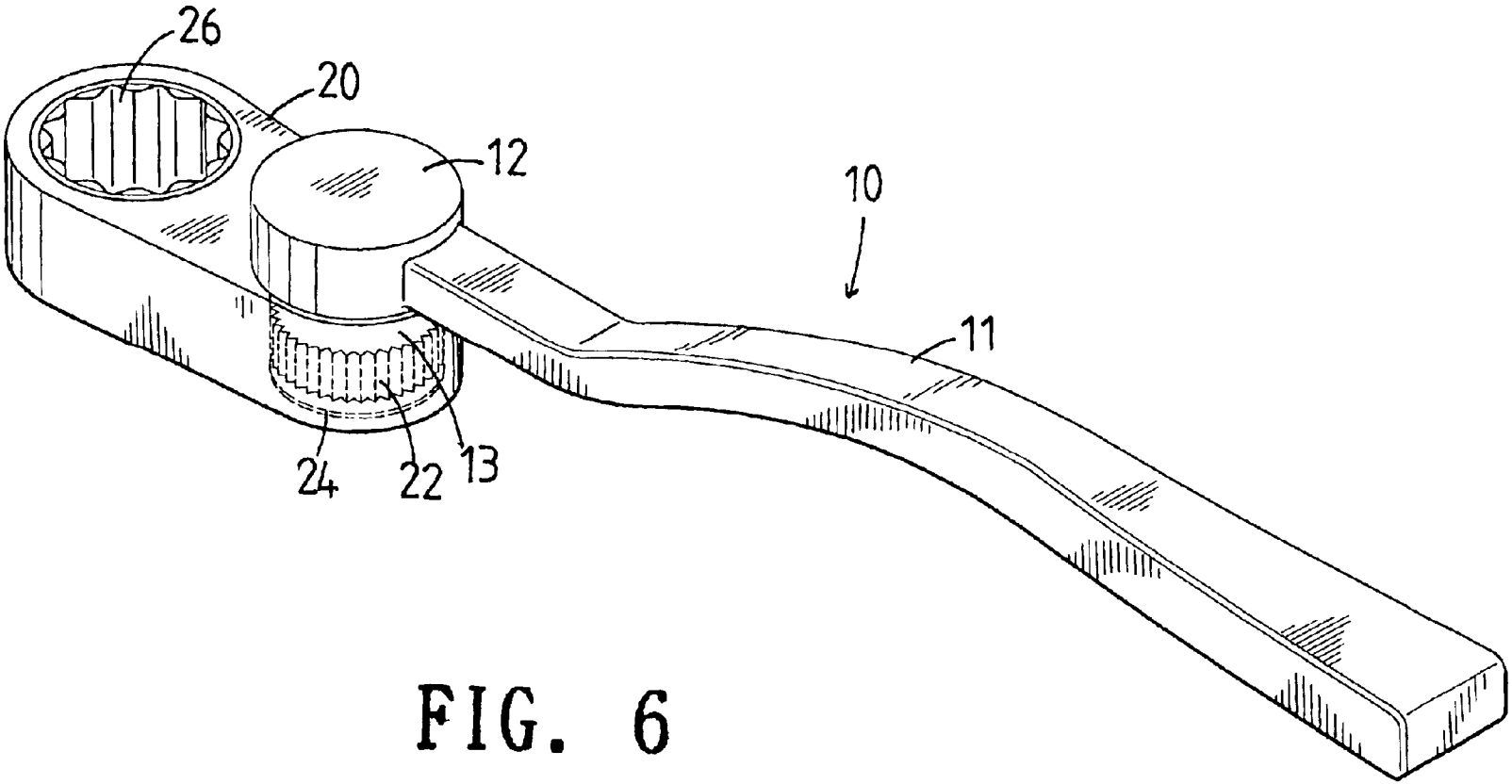
FIG. 6 is a perspective assembly view of a hand tool in accordance with another embodiment of the present invention.

Referring to FIG. 6, the hand tool in accordance with another embodiment of the present invention is shown, wherein the driving member 20 has a second end provided with a recessed mounting portion 26.

Figure 7:
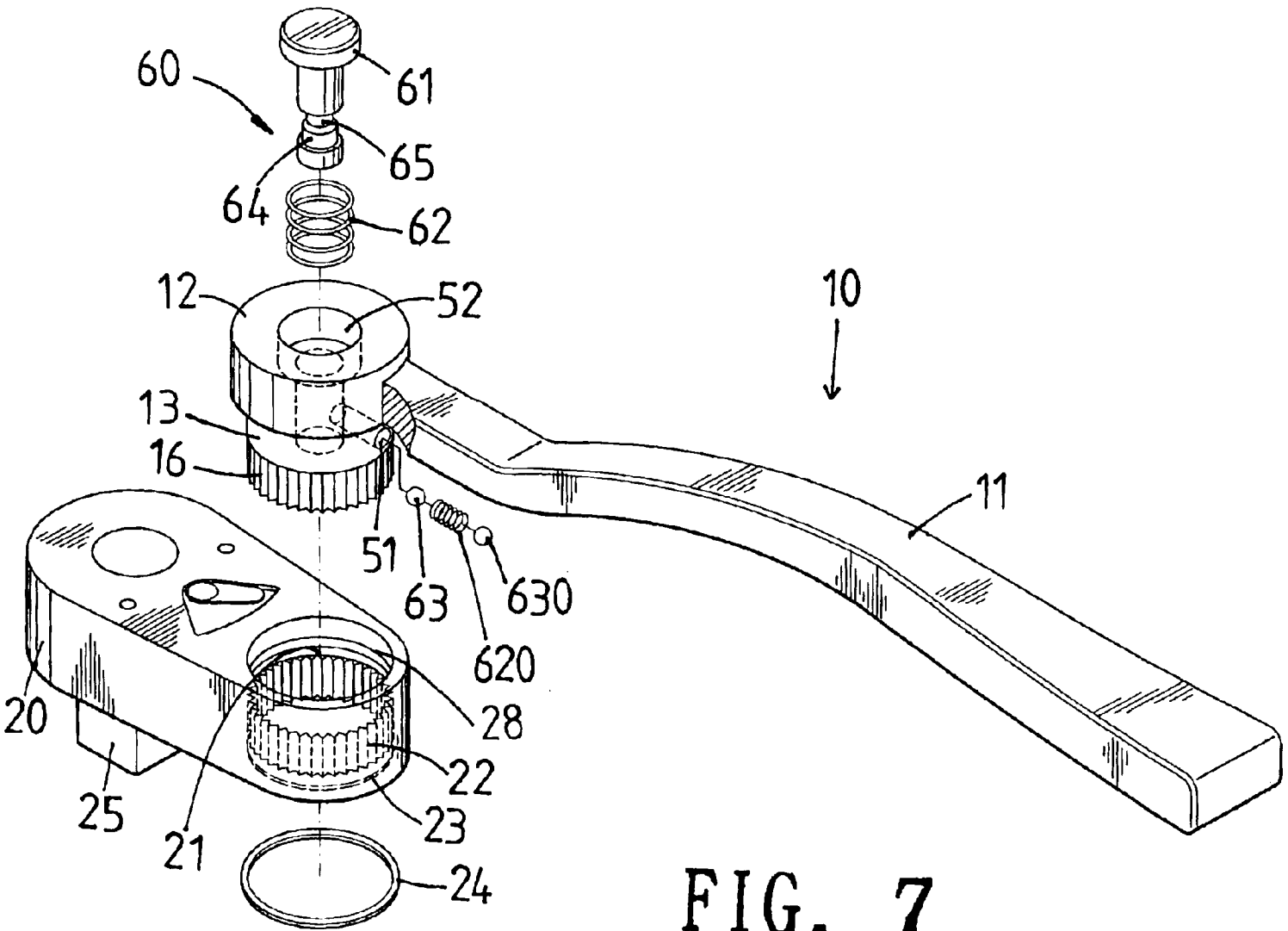
FIG. 7 is an exploded perspective view of a hand tool in accordance with another embodiment of the present invention.
Figure 8:
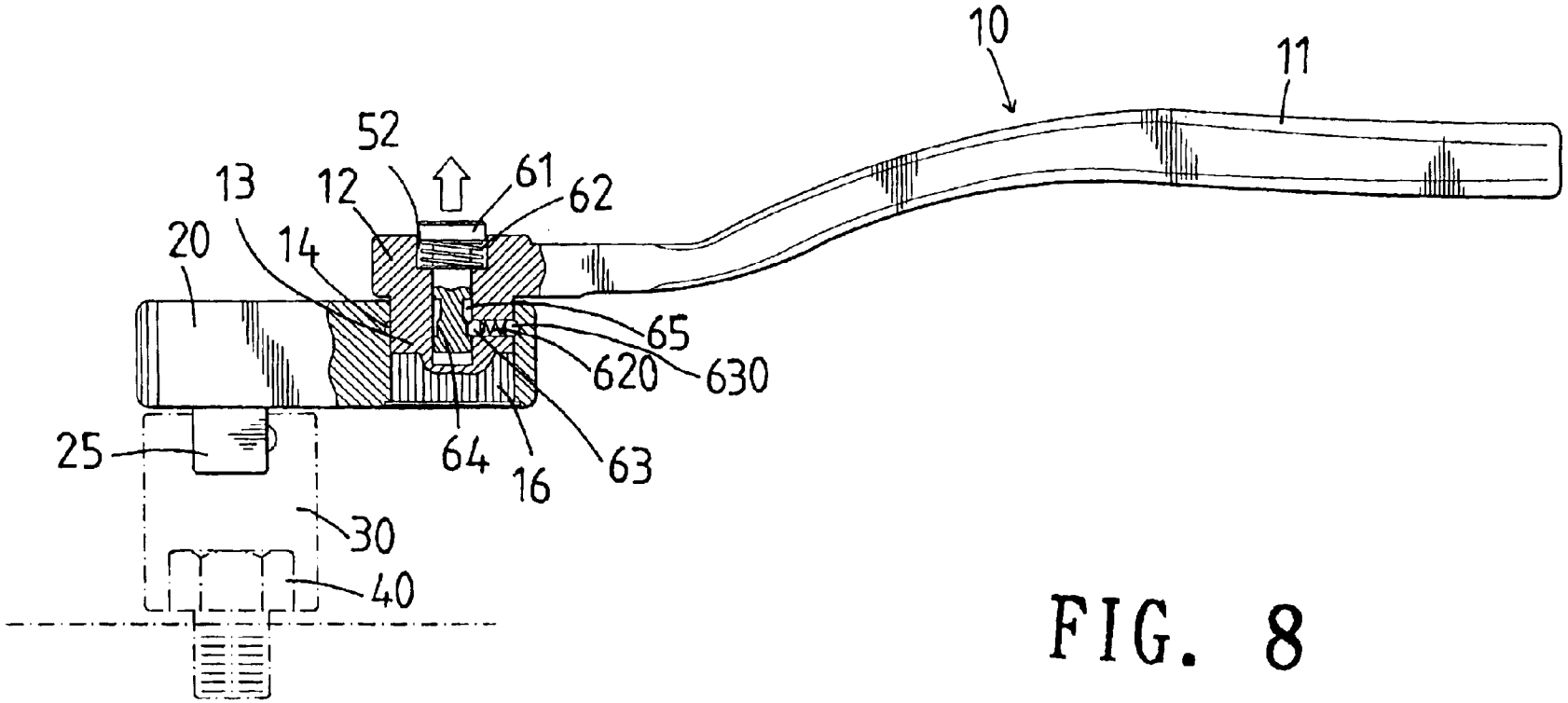
FIG. 8 is a partially plan cross-sectional assembly view of the hand tool as shown in FIG. 7.
Figure 9:
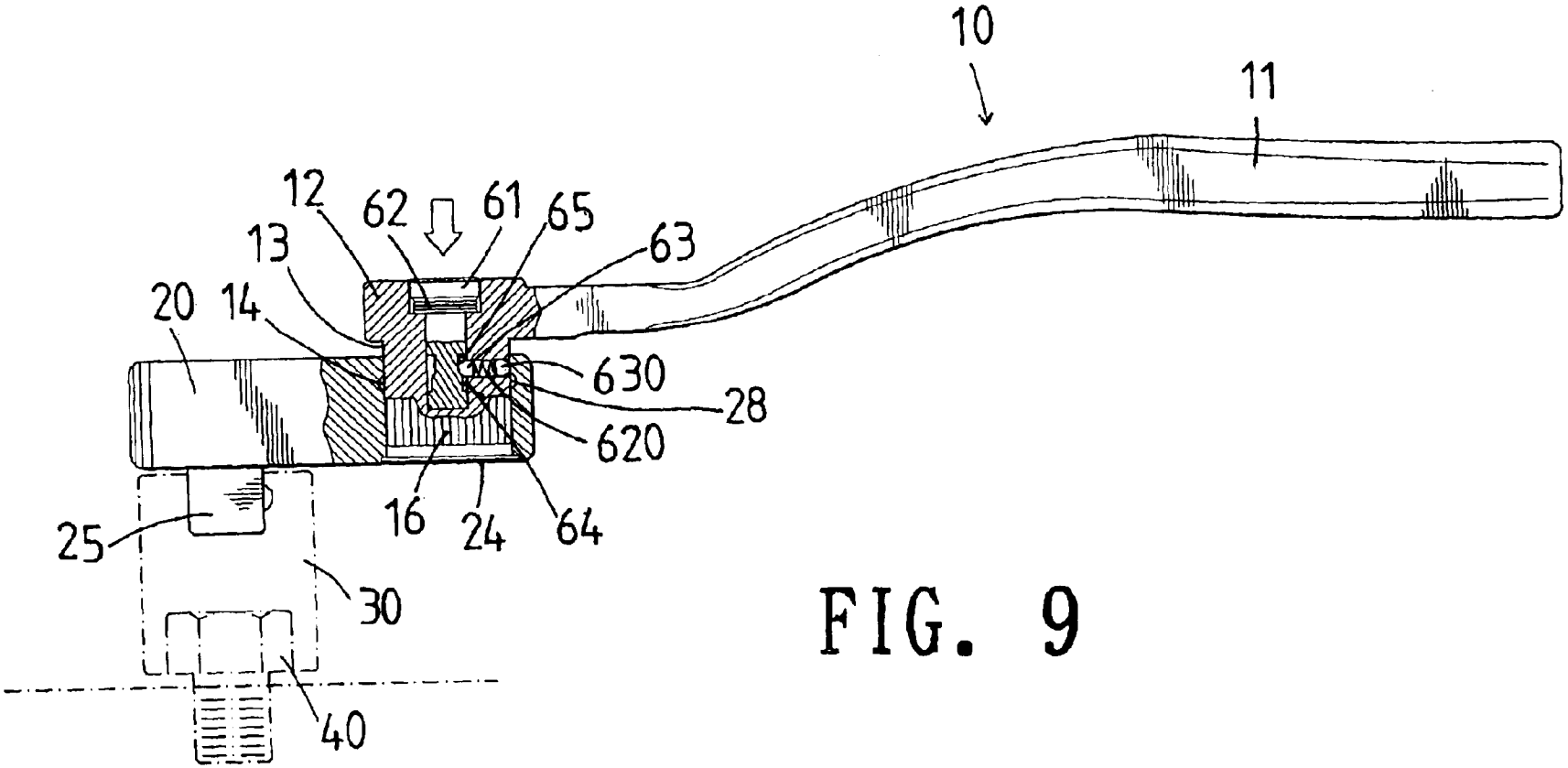
FIG. 9 is a schematic operational view of the hand tool as shown in FIG. 8.

Referring to FIGS. 7–9, the hand tool in accordance with another embodiment of the present invention is shown, wherein the mounting hole 21 of the driving member 20 has an upper end formed with an annular groove 28 located above the ratchet teeth 22, the driving head 12 of the wrench body 10 is formed with a stepped hole 52, and the locking portion 13 of the wrench body 10 has a side formed with a receiving chamber 51 communicating with the stepped hole 52. The indication 14 in FIGS. 8 and 9 indicates the annular groove 28 at another side of the locking portion 13.

The hand tool further comprises a quick release mechanism 60 mounted between the wrench body 10 and the driving member 20, so that the wrench body 10 can be detached from the driving member 20 quickly.

The quick release mechanism 60 includes a substantially T-shaped control rod 61 movably mounted in the stepped hole 52 of the driving head 12 and having a lower end formed with a convex portion 64 and a concave portion 65 located above the convex portion 64, a first spring 62 mounted in the stepped hole 52 of the driving head 12 and urged on the control rod 61 for pushing the control rod 61 upward, a first ball 63 mounted in the receiving chamber 51 of the locking portion 13 and rested on the convex portion 64 of the control rod 61, a second ball 630 mounted in the receiving chamber 51 of the locking portion 13 and locked in the annular groove 28 of the driving member 20, and a second spring 620 mounted in the receiving chamber 51 of the locking portion 13 and urged between the first ball 63 and the second ball 630. Preferably, the first spring 62 has a first end urged on a wall of the stepped hole 52 of the driving head 12 and a second end urged on an enlarged upper end of the control rod 61.

In operation, the control rod 61 is pushed upward by the first spring 62, so that the first ball 63 is rested on the convex portion 64 of the control rod 61 as shown in FIG. 8. When the control rod 61 is pressed downward, the first ball 63 is received in the concave portion 65 of the control rod 61 as shown in FIG. 9, to restore the second spring 620 so that the second ball 630 is detached from the annular groove 28 of the driving member 20, and the wrench body 10 can be detached from the driving member 20 quickly.

Figures 10, 11:
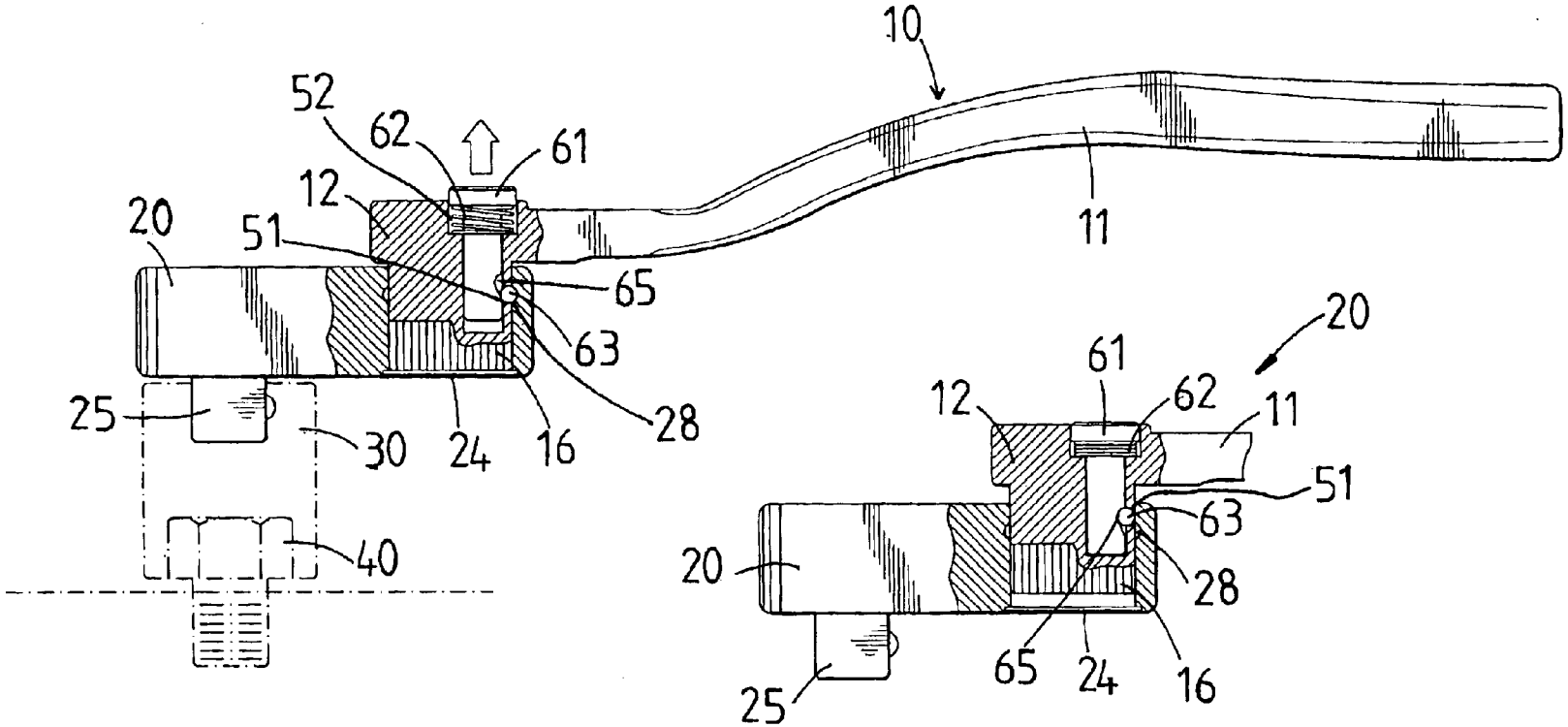
FIG. 10 is a partially plan cross-sectional assembly view of a hand tool in accordance with another embodiment of the present invention.
FIG. 11 is a schematic operational view of the hand tool as shown in FIG. 10.

Referring to FIGS. 10 and 11, the hand tool in accordance with another embodiment of the present invention is shown, wherein the quick release mechanism 60 only includes a ball 63 rested on a wall of the lower end of the control rod 61 and locked in the annular groove 28 of the driving member 20.

In operation, the control rod 61 is pushed upward by the spring 62, so that the ball 63 is rested on the wall of the lower end of the control rod 61 and locked in the annular groove 28 of the driving member 20 as shown in FIG. 10. When the control rod 61 is pressed downward, the ball 63 is received in the concave portion 65 of the control rod 61 as shown in FIG. 11, so that the ball 63 is detached from the annular groove 28 of the driving member 20, and the wrench body 10 can be detached from the driving member 20 quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hand tool, comprising: a driving member, and a wrench body mounted on the driving member for driving the driving member, wherein; the driving member has a first end formed with a mounting hole; the wrench body includes a handle, a driving head mounted on an end of the handle, and a locking portion mounted on the driving head and inserted into the mounting hole of the driving member:

wherein the mounting hole of the driving member has an upper end formed with an annular groove, the driving head of the wrench body is formed with a stepped hole, the locking portion of the wrench body has a side formed with a receiving chamber communicating with the stepped hole, and the hand tool further comprises a quick release mechanism mounted between the wrench body and the driving member, so that the wrench body can be detached from the driving member.

2. The hand tool in accordance with claim 1, wherein the quick release mechanism includes a control rod movably mounted in the stepped hole of the driving head and having a lower end formed with a convex portion and a concave portion located above the convex portion, a first spring mounted in the stepped hole of the driving head and urged on the control rod, a first ball mounted in the receiving chamber of the locking portion and rested on the convex portion of the control rod, a second ball mounted in the receiving chamber of the locking portion and locked in the annular groove of the driving member, and a second spring mounted in the receiving chamber of the locking portion and urged between the first ball and the second ball.

3. The hand tool in accordance with claim 2, wherein the control rod is substantially T-shaped.

4. The hand tool in accordance with claim 2, wherein the first spring has a first end urged on a wall of the stepped hole of the driving head and a second end urged on an enlarged upper end of the control rod.

5. The hand tool in accordance with claim 2, wherein the control rod is pushed upward by the first spring, so that the first ball is rested on the convex portion of the control rod.

6. The hand tool in accordance with claim 2, wherein when the control rod is pressed downward, the first ball is received in the concave portion of the control rod to restore the second spring so that the second ball is detached from the annular groove of the driving member, and the wrench body can be detached from the driving member.

7. The hand tool in accordance with claim 1, wherein the quick release mechanism includes a control rod movably mounted in the stepped hole of the driving head and having a lower end formed with a concave portion, a spring mounted in the stepped hole of the driving head and urged on the control rod, and a ball mounted in the receiving chamber of the locking portion and locked in the annular groove of the driving member.

8. The hand tool in accordance with claim 7, wherein the control rod is substantially T-shaped.

9. The hand tool in accordance with claim 7, wherein the spring has a first end urged on a wall of the stepped hole of the driving head and a second end urged on an enlarged upper end of the control rod.

10. The hand tool in accordance with claim 7, wherein the control rod is pushed upward by the spring, so that the ball is rested on a wall of the lower end of the control rod.

11. The hand tool in accordance with claim 7, wherein when the control rod is pressed downward, the ball is received in the concave portion of the control rod to detach from the annular groove of the driving member, so that the wrench body 10 can be detached from the driving member.

* * * * *